US007372207B2

(12) United States Patent
Van Dommelen et al.

(10) Patent No.: US 7,372,207 B2
(45) Date of Patent: May 13, 2008

(54) LAMP AND METHOD OF MANUFACTURING A LAMP

(75) Inventors: Mark Josephus Lucien Maria Van Dommelen, Turnhout (BE); Guy Dillen, Turnhout (BE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 281 days.

(21) Appl. No.: 10/556,446

(22) PCT Filed: May 12, 2004

(86) PCT No.: PCT/IB2004/050642

§ 371 (c)(1),
(2), (4) Date: Nov. 10, 2005

(87) PCT Pub. No.: WO2004/102613

PCT Pub. Date: Nov. 25, 2004

(65) Prior Publication Data

US 2007/0018579 A1 Jan. 25, 2007

(30) Foreign Application Priority Data

May 16, 2003 (EP) ..... 03076489

(51) Int. Cl.
*H01J 17/18* (2006.01)

(52) U.S. Cl. ..... 313/625; 313/624

(58) Field of Classification Search ..... 313/25, 313/624, 625

See application file for complete search history.

(56) References Cited

U.S. PATENT DOCUMENTS

| | | | |
|---|---|---|---|
| 2,875,358 | A | 2/1959 | Rigden |
| 4,949,003 | A | 8/1990 | Cox et al. |
| 5,698,936 | A | 12/1997 | Marien et al. |

FOREIGN PATENT DOCUMENTS

| | | | |
|---|---|---|---|
| DE | 3611788 | A1 | 8/2007 |
| EP | 0336478 | A1 | 10/1989 |
| EP | 0414312 | A1 | 2/1991 |
| EP | 1005061 | A1 | 5/2000 |
| GB | 865928 | | 4/1961 |
| GB | 0947311 | B | 1/1964 |
| GB | 2176587 | A | 12/1986 |

*Primary Examiner*—Vip Patel

(57) ABSTRACT

A lamp comprising an elongate light source and a coaxially transparent sleeve surrounding the light source, wherein the light source is fixed at one end in the sleeve by means of a cured cement, wherein a cement barrier is present between the light source and the sleeve for preventing the cement in its uncured state from entering the middle portion of the lamp, and wherein said cemenit barrier is made of a somewhat flexible material.

14 Claims, 2 Drawing Sheets

LAMP AND METHOD OF MANUFACTURING A LAMP

Figure 1:
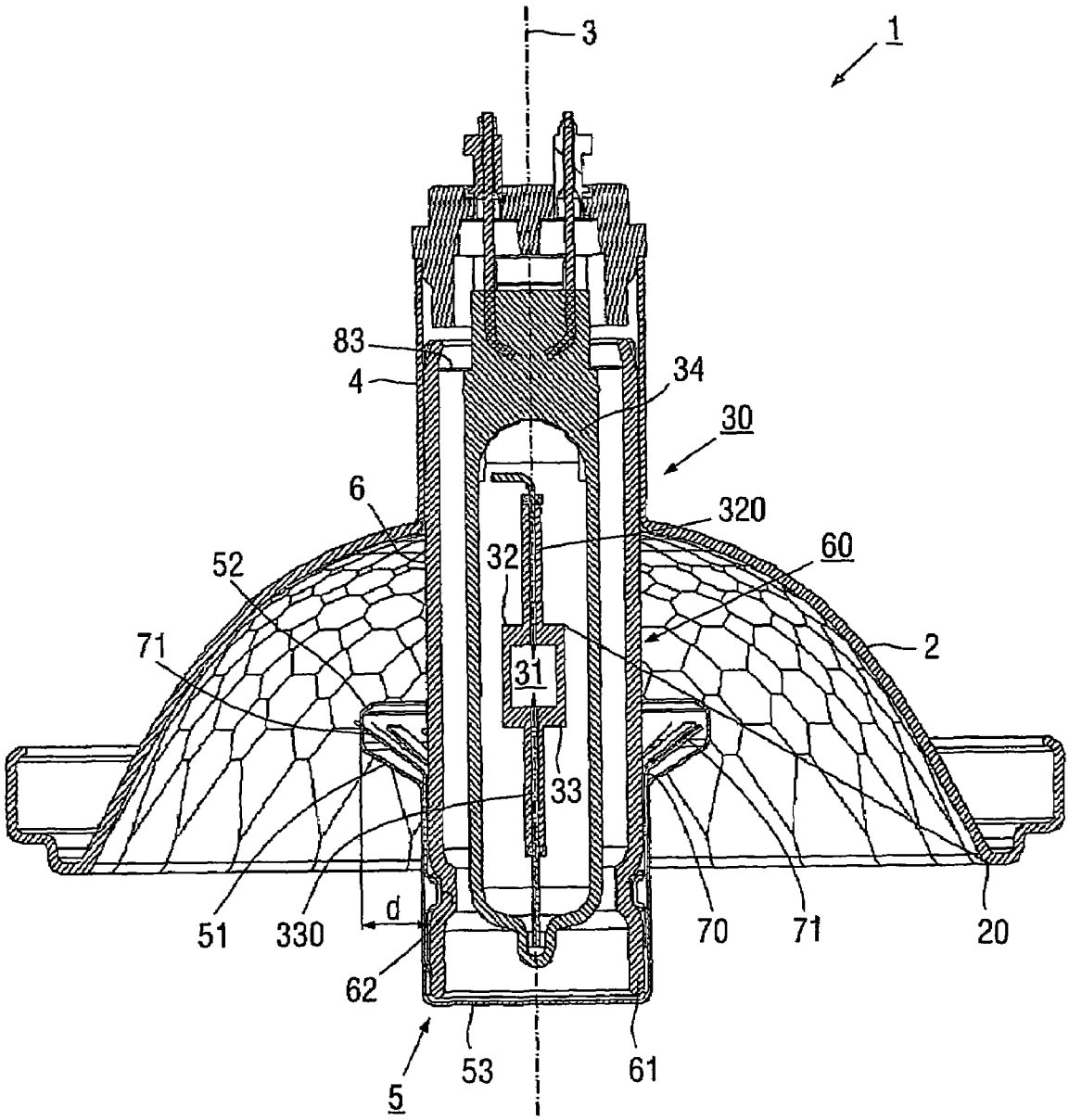

The invention relates to a lamp comprising an elongate light source and a coaxially transparent sleeve surrounding the light source.

Such a lamp is described in EP-A-0 336 478. In the known lamp, the light source and the sleeve are both mounted in a base. Such transparent sleeves have to be able to withstand the high temperatures occurring in lamps and thus are in general made of glass, quartz glass or quartz. Although it is not described how the light source and the sleeve are mounted in said base, it can be seen that the base, which comprises the current supply conductors, is relatively large, which is disadvantageous for its reliability. The invention aims at a more compact and reliable mounting solution.

To that end, the light source is fixed at one end in the sleeve by means of a cured cement, wherein a cement barrier is present between the light source and the sleeve for preventing the cement in its uncured state from entering the central portion of the sleeve, and said cement barrier is made of a non-metallic somewhat flexible material. Preferably, said light source and said sleeve are mounted on a ceramic base by means of the preferably ceramic cement, and preferably also a reflector is mounted on said base by means of the cement. In this manner a very compact lamp base can be obtained, in which the position of the light source can be maintained in a very reliable and precise manner. Also the current supply conductors are safely enclosed in said cement.

The cement barrier should have some flexibility, because it was found that the sleeves or the burners tended to crack very often when a metal cement barrier was used. The cracking was mainly caused by the large difference in thermal expansion between the metal cement barrier and the quartz or quartz glass sleeve, and the forces that are applied to the quartz or quartz glass sleeve thereby. Therefore, the term flexibility should be interpreted as being more flexible and/or softer than glass, quartz glass and quartz. If a material having flexibility (called flexible material) is used, these forces will be easily absorbed.

Preferably, the non-metallic flexible material retains its shape at temperatures above 150° C., preferably above 200° C., more preferably above 250° C. In a preferred embodiment said non-metallic material has a smooth surface towards the cement, which counteracts adherence of the cement on to the cement barrier material. Suitable materials are mica and various synthetic materials or plastics. In particular mica has been found very useful, because it can easily withstand lamp temperatures up to 400° C. Also the cement will not adhere to the mica plate, which is a further advantage in avoiding high stresses.

In a further preferred embodiment the flexible material of the cement barrier has a fibrous surface towards the cement. Because of the fibrous structure of the said materials the surface facing the cement will form a barrier to which the cement may adhere and at the same time the surface will easily absorb differences in thermal expansion and thus avoid the built up of thermal stresses between the different parts. In particular glass wool or ceramic wool have turned out to be suitable fibrous materials from which the non-metallic cement barrier can be formed.

In yet a further preferred embodiment the flexible material is formed by a synthetic material. An advantage of synthetic material is the very vast amount of available materials from which a selection can be made. Important in the selection is that the selected material has the suitable thermal properties to persistently withstand temperatures of 150° C. and more. Very suitable in this respect is polytetrafluoroethylene (PTFE).

In a preferred embodiment, said light source comprises a ceramic burner, and said sleeve is made of quartz glass or quartz.

The invention furthermore relates to a method of manufacturing a lamp wherein an elongate light source is coaxially inserted in a transparent sleeve, wherein a cement barrier made of a somewhat flexible material is placed between the light source and the sleeve, and wherein a liquid cement is poured onto said barrier for fixing said light source in said sleeve.

Figure 2:
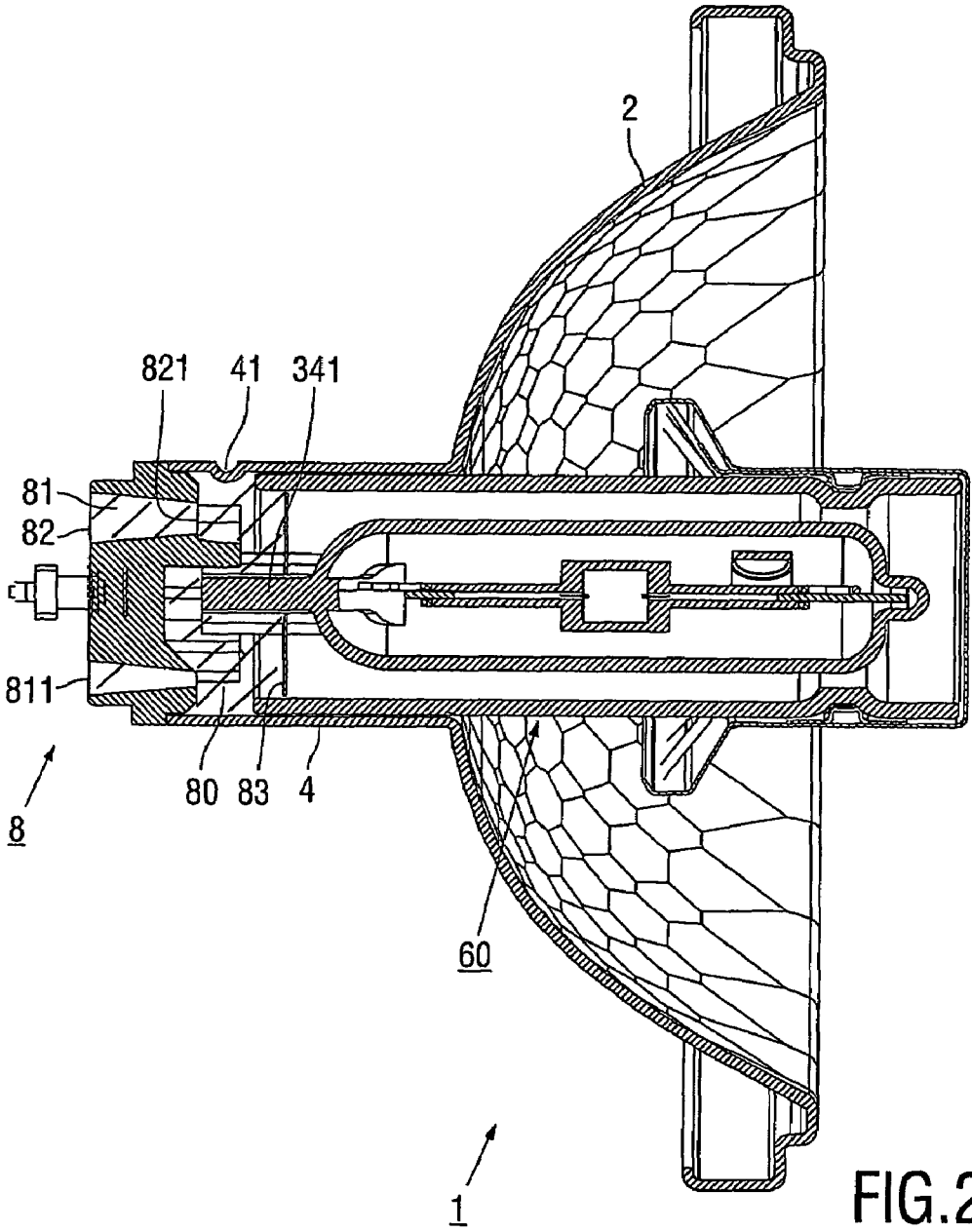
Figure 3:
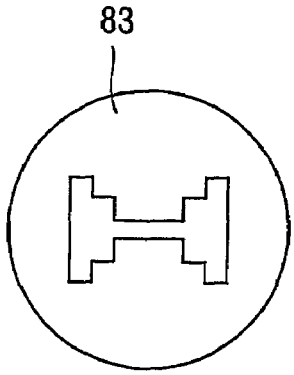

The above and further aspects of the invention will be illustrated with reference to the drawings, wherein FIG. 1 is a cross-section of a lamp unit according to the invention, FIG. 2 shows another embodiment of the lamp unit according to the invention, and FIG. 3 is a plan view of a cement barrier used in the lamp unit according to the invention.

In FIG. 1, a lighting unit 1 is provided with a concave reflector 2 having an axis of symmetry 3 and a light emission window 21 bounded by a circumferential edge 20 of the reflector transverse to said axis, with an elongate light source 30 axially arranged substantially symmetrically on the axis of symmetry and accommodated in a holder 4 opposite the light emission window, and with an axially positioned cap 5 serving as an optical screening means that partly surrounds the light source for intercepting unreflected light rays. The light source is surrounded by a sleeve 60 having an end 61 that faces the light emission window. The cap 5 is positioned over the sleeve adjacent an end thereof by means of a locking element 70 provided at the sleeve. In the embodiment shown, the light source is formed by a ceramic discharge vessel 31 which is provided with external closing plugs 320, 330 at respective axial end faces 32, 33 for positioning lead-through elements to electrodes arranged in the discharge vessel, between which electrodes a discharge extends in the operational condition. This is a metal halide discharge in the example described. The discharge vessel is accommodated in an outer bulb 34. The outer bulb 34, sleeve 60, and reflector 2 are indetachably connected to one another at the area of the holder 4 in the case described. The reflector and the light source have thus been integrated into a metal halide lamp.

The sleeve 60 is a tubular body of hard glass over which the cap 5 has been passed at the area of the end 61. The cap is provided with a screening ring 51 at the side facing away from the light emission window, which ring extends radially away from the light source over a distance d. The positioning of the screening ring effectively prevents an unreflected emission of light originating from that portion of the light source that is situated between the cap and the holder. The screening ring is provided with a ring edge 52, and the locking element 70 is provided with a tag-shaped element 71 that grips into the ring edge under spring force in a direction radially away from the light source. At least one recess 62 is provided in an outer surface 6 of the sleeve 60, into which a portion of the locking element 70 grips under spring force.

FIG. 2 shows a further advantageous embodiment in which the holder 4 is provided with a base 8 with electrical connection contacts for connecting an electrical supply source.

The reflector and the light source are preferably indetachably connected to one another so as to form a lamp, preferably at the area of the holder 4.

In FIG. 2, the holder 4 is provided with a locking mechanism 41 adjacent a connection to the light source 34 and the sleeve 60 in the form of an indentation close to an end of the holder 4. This indentation is shaped such that the coupling between the reflector on the one hand and the light source and sleeve on the other hand remains intact in spite of differences in expansion during operation of the light source. Very favorable is a situation in which three indentations 41 are provided at equal mutual distances on the circumference of the relevant end of the holder.

The base 8, holder 4 and sleeve 60 are joined to a seal 341, for example in the form of a pinch, of the light source by means of a cured cement 80. The base 8 is provided with a filling hole 81 and a rise hole 811 for providing the cement in its uncured form, that is the still liquid cement mass. In a manner known per se, the cement mass is cured by heating into cured cement 80, whereby the joint mentioned above is created. The choice of a filling circumference 82 for the filling hole 81 greater than an exit circumference 821 advantageously achieves that the cement 80 in the cured state forms an interlocking fixture. This is realized in the embodiment shown in that the filling hole 81 has a tapering gradient in cross-section. The interlocking effect is further enhanced in that the rise hole 811 also has a tapering gradient with a greatest diameter at the side remote from the holder 4.

A plate 83 extending circumferentially at least substantially up to the wall of the sleeve 60 is arranged around the seal 341 of the light source. FIG. 3 is a plan view of the plate 83. This plate serves to stop the uncured cement, that is the still liquid cement mass 80 during filling. Thus the plate 83 forms the cement barrier. The plate 83 should be heat resistant, preferably up to 150°, more preferably up to at least 200°, even more preferably up to at least 250°. In one aspect of the invention, the cement 80 should preferably not adhere to the plate 83, otherwise cracks could arise owing to a difference in coefficient of expansion. Consequently the material of the plate 83 has preferably a smooth surface towards the cement. In another aspect of the invention the material of the plate 83 has a fibrous surface towards the cement 80, which it is true will promote adherence of the cement. However, differences in coefficient of expansion will then easily by absorbed by the fibrous structure of the material. Furthermore, the material should preferably not be too rigid, because otherwise the plate 83 could destroy the glass of the seal 341 or the sleeve 60 by pressure. Another property the material should preferably have is that it is not too brittle.

Metals were accordingly found to be not particularly suitable materials for the plate 83. Consequently the material of plate 83 should be somewhat flexible, at least more flexible than metal and than glass, quartz glass and quartz. A very suitable non-metallic material was found to be mica. Glass wool as a fibrous non-metallic material also turns out to be a suitable material as well as ceramic wool. Other examples of non-metallic materials from which the plate may preferably be manufactured are various synthetic materials such like phenolic and unsaturated polyester resins, polyamide, flexible PVC, polyester thermoplastic elastomer (TPE), olefinic TPE, polyester alloy, thermoplastic polyimide, acrylic and epoxy resins, fluoropolymers, for instance polytetrafluoroethylene (PTFE), styrenic resins, and polyester carbonate.

The invention claimed is:

1. A lamp comprising an elongate light source and a coaxially transparent sleeve surrounding the light source, wherein the light source is fixed at one end in the sleeve by means of a cured cement, wherein a cement barrier is present between the light source and the sleeve for preventing the cement in its uncured state from entering the central portion of the sleeve, and wherein said cement barrier is made of a non-metallic flexible material.

2. A lamp according to claim 1, wherein said material retains its shape at temperatures above 150° C.

3. A lamp according to claim 1, wherein said non-metallic material has a smooth surface towards the cement, which counteracts adherence of the cement on to the cement barrier material.

4. A lamp according to claim 1, wherein said non-metallic material is mica.

5. A lamp according to claim 1, wherein said non-metallic material is a synthetic material.

6. A lamp according to claim 1, wherein said non-metallic material of the cement barrier has a fibrous surface towards the cement.

7. A lamp according to claim 1, wherein said non-metallic material is glass wool or ceramic wool.

8. A lamp according to claim 1, wherein said light source and said sleeve are mounted on a ceramic base by means of the cement.

9. A lamp according to claim 1, wherein a reflector is mounted on said base by means of the cement.

10. A lamp according to claim 1, wherein said light source comprises a ceramic burner.

11. A lamp according to claim 1, wherein said sleeve is a made of quartz glass or quartz.

12. A method of manufacturing a lamp, wherein an elongate light source is coaxially inserted into, a transparent sleeve, wherein a cement barrier made of a flexible material is placed between the light source and the sleeve, and wherein a liquid cement is poured onto said barrier for fixing said light source in said sleeve.

13. The lamp of claim 2, wherein said material retains its shape at temperatures above 200° C.

14. The lamp of claim 2, wherein said material retains its shape at temperatures above 250° C.

* * * * *